United States Patent [19]

Zaman

[11] Patent Number: 4,759,960

[45] Date of Patent: Jul. 26, 1988

[54] DIE BAR WITH INTEGRAL LOCKING MEANS

[75] Inventor: Mohammad F. Zaman, Fort Wayne, Ind.

[73] Assignee: Essex Group, Inc., Fort Wayne, Ind.

[21] Appl. No.: 941,903

[22] Filed: Dec. 12, 1986

[51] Int. Cl.[4] ..... B05D 1/00; B05C 11/02

[52] U.S. Cl. ..... 427/356; 118/125; 118/405

[58] Field of Search ..... 118/405, 125; 226/91, 226/92; 427/356, 434.6

[56] References Cited

U.S. PATENT DOCUMENTS

| | | | |
|---|---|---|---|
| 2,665,773 | 1/1954 | Osmun | 118/405 X |
| 2,915,580 | 12/1959 | Gill et al. | 174/43 |
| 2,928,636 | 3/1960 | Flower | 248/61 |
| 3,106,386 | 10/1963 | Harris | 263/3 |
| 3,142,588 | 7/1964 | Phillips | 118/407 |
| 3,161,724 | 12/1964 | Greene, Jr. et al. | 174/146 |
| 3,183,604 | 5/1965 | Stauffer | 34/18 |
| 3,183,605 | 5/1965 | Argue et al. | 34/68 |
| 3,265,033 | 8/1966 | Touze et al. | 118/61 |
| 3,351,329 | 11/1967 | Thomas | 263/3 |
| 3,596,634 | 8/1971 | Fuchs | 118/65 |
| 3,810,736 | 5/1974 | Dumas | 432/59 |
| 3,851,623 | 12/1974 | Landry, Jr. | 118/405 |
| 4,303,387 | 12/1981 | Burke et al. | 432/72 |
| 4,365,790 | 12/1982 | Horvath et al. | 266/103 |
| 4,448,578 | 5/1984 | Brunet et al. | 432/72 |
| 4,475,294 | 10/1984 | Henricks | 34/79 |
| 4,521,931 | 6/1985 | Katsuki et al. | 8/149 |
| 4,539,931 | 9/1985 | Kikuta et al. | 118/404 |

*Primary Examiner*—John P. McIntosh

[57] ABSTRACT

A die bar having an integral locking means for selectively engaging transport cables located along the process path of a wire coating apparatus is disclosed. The locking means allows for a die bar to be threaded with wires while in a stationary position, then to engage transport cables which draws the wires along the process path until the die bar reaches a satisfactory position in the process path, where the locking means are released. Claims disclosed are drawn to a die bar with integral locking means, and to a method of transporting wires along the process path using the disclosed die bar.

6 Claims, 2 Drawing Sheets

DIE BAR WITH INTEGRAL LOCKING MEANS

CROSS REFERENCE TO RELATED APPLICATIONS

This application relates to commonly assigned, copending U.S. patent application Ser. No. 867,717 filed May 27, 1986 for DIE BAR CARRIER by Paul E. Justus; and commonly assigned, copending U.S. patent application Ser. No. 947,167 filed Dec. 29. 1986 for DIE BAR CARRIER by Mohammad F. Zaman.

TECHNICAL FIELD

The invention relates to wire coating apparatus, particularly to die bars used in applying coatings to wire.

BACKGROUND ART

The production of magnet wire requires that a quality product be produced at a rapid rate in order to keep up with the demands of the marketplace. Competition in this area requires that such wire be produced economically, which is accomplished by selecting a rate and method of production in order to produce the maximum amount of wire at a minimum of cost, costs which include raw materials and process time.

A typical method of fabrication for such wire is a three-step process. In the first step, the "annealing step", bare wire of a desired diameter is drawn from a supply through an annealing oven in order to soften it and increase its flexibility as required in subsequent process steps.

In the second step, the "coating step", the bare wire exiting the annealing oven passes through a slip containing an "insulating enamel" typically a mixture comprised of polymers in organic solvents. The wire drawn through the slip then passes through a die having a passage of a dimension to allow only the wire and a layer of insulating enamel adhering to the wire to pass through to form a "coated wire". Any excess insulating enamel is returned to the slip.

The coated wire passes next to the third step, the "drying and curing" step. For this step a vertical oven is typically used, one maintained to have a temperature gradient across the path of the coated wire being drawn through it. At the bottom where the coated wire enters, the temperature is maintained to allow the gradual evaporation of the organic solvents in the insulating enamel. At the top end of the oven where the coated wire exits, a relatively higher temperature is maintained to insure the curing of the polymers in the insulating enamel. The wire having a layer of cured insulating enamel and exiting from the top of the oven comprises an "insulated wire" which may be wound onto a takeup spool.

The wire formed as noted in the above-outlined process sequence is rarely useful as the insulation layer formed by one coating step is too thin. Rather, the insulated wire is taken from the oven and redrawn through the coating step where a second layer of insulating enamel adheres to the wire, which is then passed through a second die which has a passage of a larger dimension than the first die, and drawn through the oven for drying and curing of the second layer. It should be noted that the second die functions in the same manner as the prior die, and differs only in that its passage is of a slightly larger dimension than that of the prior die. This allows for the thickness of the insulation on the wire to be increased by the second coating step.

This method of adding coatings to the wire may easily be repeated any desired number of times and requires only that successive dies have passages with progressively increasing dimensions to assure the formation of a plurality of progressively increasing insulation layers on the wire. This method of multiple coating is preferred as it is well known in the art that insulated wires formed with a plurality of insulating layers are more flexible and more resistant to cracking of insulation than wires having one thick layer of insulation.

The dies used in the coating step may be retained in a structure known as a die bar. Typically, the die bar is a rectangular bar having suitably formed holes within which individual dies may be secured. The die bar itself is positioned above the slip and below the oven, and acts to retain the dies in this location, and to simultaneously provide separation between the wires passing through the dies, assuring that they will maintain a generally parallel orientation as they pass between the slip and the oven entrance. Further retention of parallel orientation of wires is provided by two sets of sheaves, a first "feed sheave" set situated below the slip, die bar and oven which acts to receive bare wire from a feed spool and insulated wire returning from the oven exit to be recoated, and a second "return sheave" set of sheaves situated above the exit of the oven, which acts to receive insulated wire exiting the oven and return it to the lower sheave for subsequent recoating, or return it to a takeup spool where the fully insulated wire or "product wire" is wound. Generally, the spacing between the wires passing around the first and second set of sheaves is equal to the spacing of the wires passing through the die bar. This assures that the wire remains parallel during the second and third steps of the process which is frequently repeated. It is seen then, that the wire taken from a supply spool for coating may complete several successive "passes" of being processed, namely successive cycles of "coating" steps followed by drying and curing steps. Each pass of wire then receives an additional coat of enamel insulation, and the number of passes that each wire takes determines the number of coats of insulating enamel. Additionally, the path that the wire takes through the machine in the completion of each pass defines the "process path".

The production of enamel insulated wire usually entails the simultaneous production of several separate wires, each undergoing multiple passes through the process path. In this way, several separate wires may be simultaneously produced to effect a savings in production time and energy. This method requires that several die bars be used, where each die bar contains dies having passages of the same dimension, and the several die bars are serially positioned in the wire coating apparatus so that the wire progressively passes from the die bar having the smallest size dies to the die bar having the largest size dies during the multiple passes of the coating operation. The several die bars having such a placement assures the formation of progressively increasing insulation layers on each wire during the process.

This method of simultaneously producing several insulated wires by multiple passes through the process path, requires a "multi-wire multi-pass" operation where, at the start up of production, the wires be threaded through the complete process path for each pass. This operation may be performed manually by an operator who threads ends of the several feed wires from the annealing oven around sheaves in the first set of sheaves, then through the slip and then threads each wire through dies in a first die bar, then pulls the wires through the oven and threads them around sheaves in the second set of sheaves and return them to the first set of sheaves. This process continues until the wires have been passed through the process path for the desired number of passes and the requisite number of dies. Then the wires are threaded onto takeup spools, and once the wire is completely threaded, the production of magnet wire may begin.

This process is time consuming, difficult, and wasteful of material, as wire frequently breaks during the threading operation as a consequence of the prior annealing process which has softened the wire. Further, the wire used for threading the coating apparatus must be discarded as waste, as the portions which pass through the hot oven have remained in the oven for a time greater than the normal "residence time", namely, the normal length of time that any segment of the wire remains in the oven during normal processing. Wire which has been treated in excess of the normal residence time frequently suffers unacceptable oxidation on their surface due to the prolonged heat exposure encountered. Excess oxidation of a wire results in the formation of flakes on the outer surface which frequently fall off which does not provide a good surface for the adhesion of insulating enamel. Accordingly, a better method of threading wire along the process path of a wire coating apparatus is needed.

This problem was addressed in commonly assigned U.S. patent application titled "Die Bar Carrier", Ser. No. 867,717, filed May 27, 1986. There an apparatus is disclosed which is used to thread the wires in a multi-wire multi-pass wire coating process through the wire coating apparatus. A die bar carrier is used in conjunction with a pair of parallel transport cables which run along the process path, and a die bar. In use, the die bars containing a plurality of dies are threaded with the ends of bare wires passing from the annealer, and then the die bar carrier is placed underneath the die bars and is used to simultaneously engage the transport cables and support the die bars. The moving transport cables carry the threaded die bars and wires through the process path and automatically thread the wires onto the proper sheaves during its travel. The transport cables can be stopped at any point so as to allow the manual disengagement of bar carrier, and remove it from among the wires and from beneath the die bar in order to position the die bar in the wire coating apparatus. The die bar carrier could then be reinserted between the transport cables and the wires and beneath the remaining die bars, and reengaged. Then the transport cables could be restarted to complete another pass where the next die bar could be released. This process continues until all of the die bars have been positioned and wires have been threaded through the wire coating apparatus. This die bar carrier offers significant advantages over hand threading wires through a wire coating apparatus, but there remains a continuing need in the art for devices which may be utilized in threading a wire coating apparatus used in multi-wire, multi-pass coating process.

DISCLOSURE OF THE INVENTION

An object of the invention is to provide a die bar with integral, locking means which may be utilized in conjunction with parallel transport cables to thread wires in a wire coating apparatus.

Another object of the invention is to provide an improved method for transporting wires along the process path of a wire coating apparatus, useful for threading wires in a wire coating apparatus.

According to the invention, a die bar having two ends and at least one die situated therebetween wherein the die bar includes holes at or near the ends which are suitably sized for the passage of parallel transport cables therethrough and releasable locking means incorporated in the die bar for the purpose of engaging the portion of transport cables passing through the holes at the ends of the die bar is disclosed.

One aspect of the invention is a die bar as described above which a tapered key suited to be slideably engaged against the each of the holes and against the transport cable which comprise a locking means.

A further aspect of the invention is a die bar as described above wherein the tapered key includes a release arm for selectively disengaging the tapered key from the transport cable and from the hole.

Another aspect of the invention is to provide a method for transporting wires along the process path of a wire coating apparatus having the elements outlined above where the method comprises the following steps: threading at least one wire through at least one die in a die bar, securing the section of the wire which has passed through the die bar, engaging the locking means within the die bar in order to engage the transport cable passing through the die bar, and moving the transport cable along the process path.

An additional aspect of the invention comprises a method for transporting wires along the process path of a wire coating apparatus as outlined above which further includes the step of releasing the engaged locking means in order to disengage the transport cables after the die bar has reached a satisfactory position in the process path.

A still further aspect of the invention is to provide a method of transporting wires along the process path of a wire coating apparatus wherein the wires are passed through a plurality of dies in a plurality of additional die bars.

Other features and advantages will be apparent from the specification and claims and from the accompanying drawings which illustrate an embodiment of the invention.

BEST MODE FOR CARRYING OUT THE INVENTION

Figure 1:
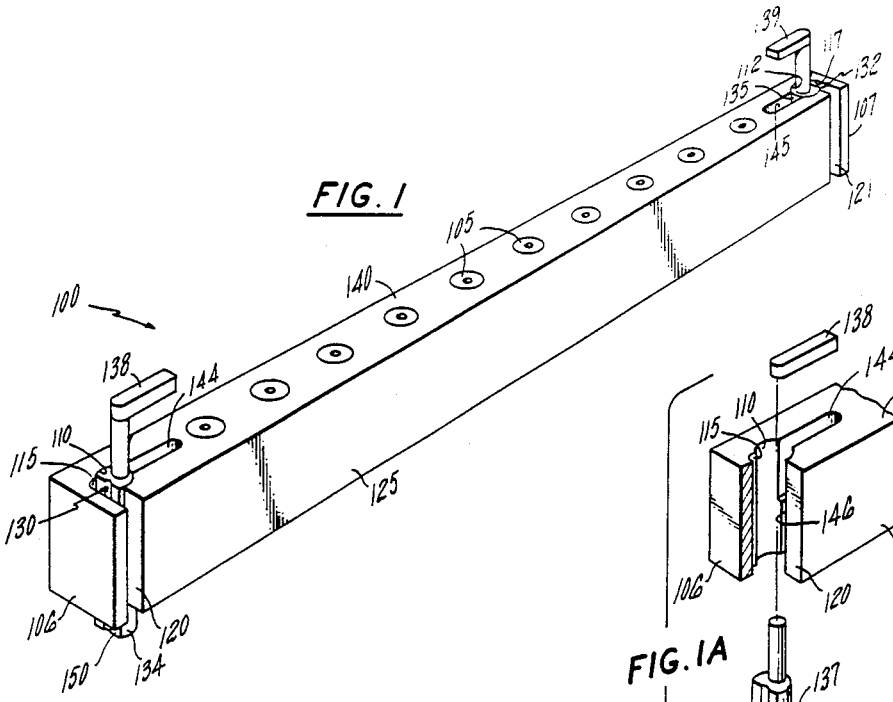
FIG. 1 is a perspective view of a die bar of this invention having identical locking means at each end in the form of tapered keys having a release arm.
Figure 1A:
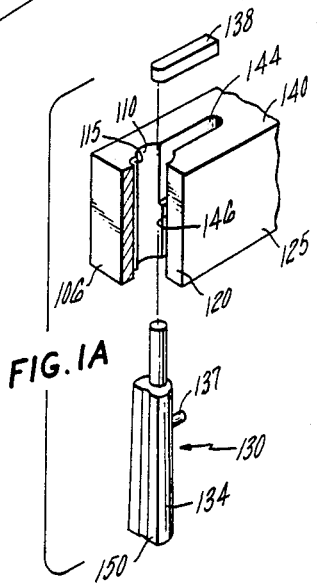
FIG. 1A is an exploded perspective view of one of the locking means.
Figure 2:
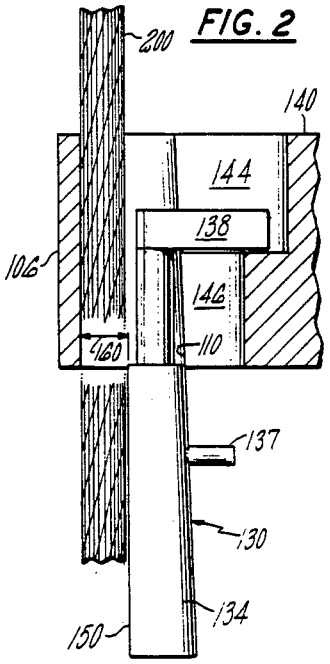
FIG. 2 is an enlarged sectional view of the locking means shown in the unsecured position.
Figure 3:
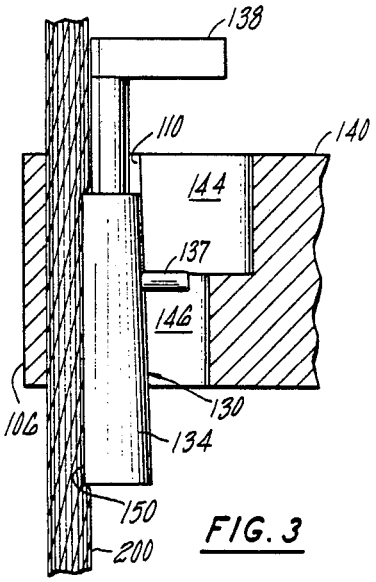
FIG. 3 is a view similar to FIG. 2 but in the secured position.

FIGS. 1 and 2 show an embodiment of the invention. A die bar 100 having two ends 106,107 is shown in which ten dies 105 are inserted. Also shown are two holes 110, 112 at or near the ends of the die bar 100 each having a tapered portion and a small arcuate section 115, 117 incorporated along one side of each hole 110, 112 passing through the die bar 100 for the purpose of positioning a transport cable passing through. Passages 120, 121 connect the front surface 125 of the die bar 100 with ends of the holes 110,112 passing therethrough. These passages allow for the die bar to be strung onto two parallel transport cables 200 by providing a means to admit transport cables into the holes 110, 112 in the die bar. Also shown are locking means 130, 132 each comprising tapered key portions 134, 135 having a release arm 138, 139 extending from the upper surface of the tapered key and affixed thereto. Extending above the upper surface 140 of the die bar 100 alignment pins 137 (only one of which is shown) extend from the tapered key portions parallel to and aligned with release arms, which serve to position locking means 130, 132. Also provided in the die bar 100 are recesses 144, 145 and 146 (only one of which is shown) which are suitably dimensioned to fit the release arms and alignment pins respectively. In operation the release arms 138, 139, tapered key portions 134, 135 and recesses 144, 145 of the die bar 100 cooperate in the following fashion. When the key is in the "unsecured" position as shown in FIG. 2, the release arm 138 is enclosed totally within the die bar 100. The tapered key portion 134 having a substantially flat portion 150 thereon, extends downward below the die bar 100 and due to the communication of the flat portion 150 of the key 134 and the passage 120 passing through the die bar 100, a gap 160 allows for the passage of the transport cable 200; alternatively, when in the "secured" position as shown in FIG. 3, wherein the release arm 138 extends above the upper surface 140 of the die bar 100 and the tapered portion of the key 134 has been forced upwardly in the die bar hole 110 so as to be in contact and secure the die bar 100 to the transport cable 200 passing through. At this point, alignment pin 137 is totally within the recess 146 to maintain the key in the proper orientation.

Figure 4:
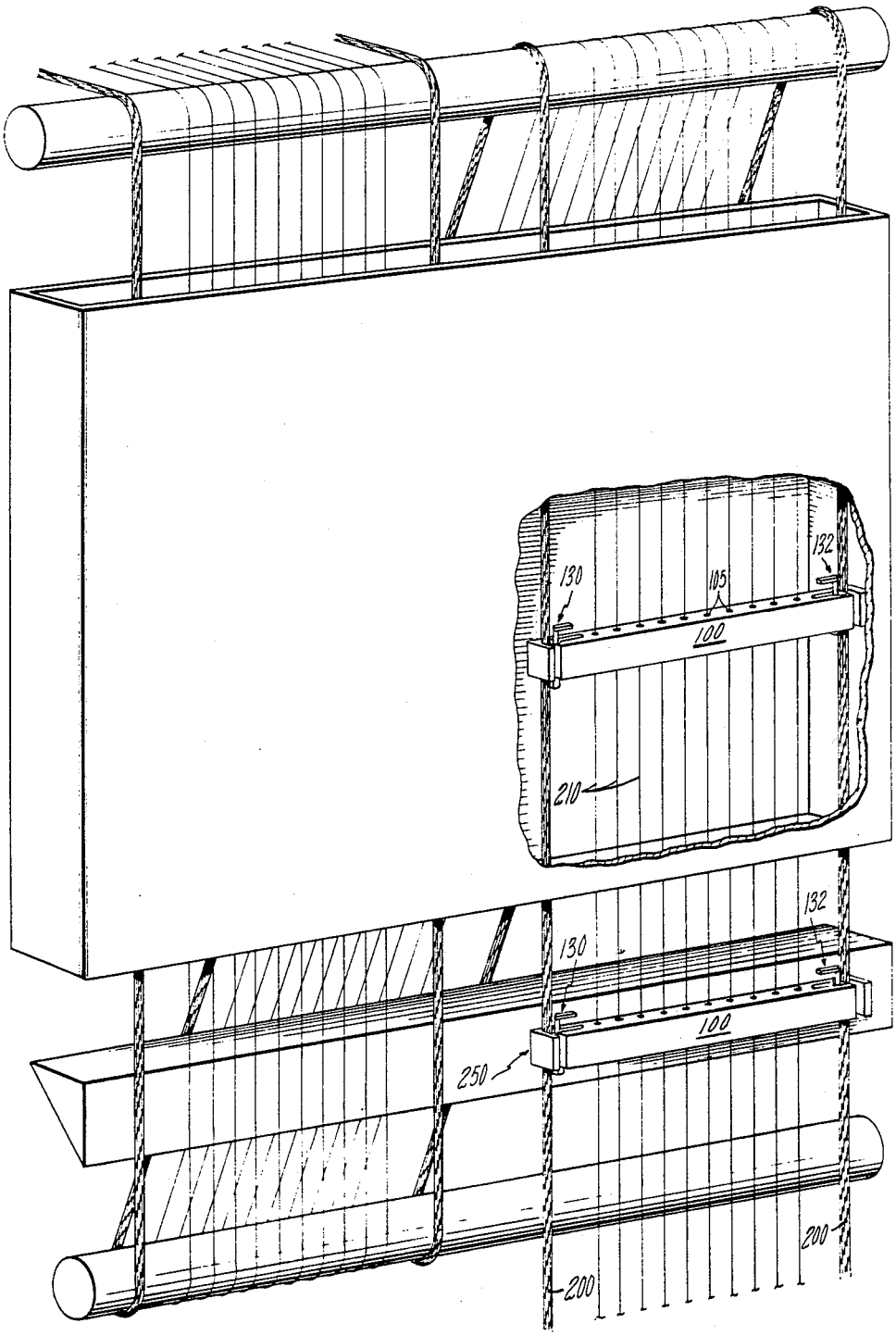
FIG. 4 is a view of the die bar of this invention engaging transport cables located along the process path of a wire coating apparatus.

FIG. 4 shows the die bar 100 positioned and secured between two parallel transport cables 200. This may be accomplished as described above. Then, bare wires 210 are fed from the annealing oven or supply spools (not shown) and are threaded through the dies 105 situated in the die bar 100. The portion of the bare wires passing through the die may be secured simply by bending, twisting, or using a clip for the purpose of denying passage of the wire back and out of the die during the threading process. Next, the transport cables are moved and the die bar 100 which is secured to the transport cables by the locking means moves with the transport cables 200 and it may continue along the process path until it reaches a desired location such as 250. Then, the transport cables 200 may be disengaged from the die bar 100 by releasing the locking means. In the preferred embodiment this is accomplished by depressing the release arms 138,139 which will disengage the tapered key 134, 135 from the transport cables 200 and by virtue of the recesses 144, 145 of the die bar 100, the release arm 138, 139 will collapse and be retained in the recesses 144, 145 in a position below the upper surface of the die bar 140. This is especially convenient if used with a clamping means or retaining means positioned within the process path. The die bar 100 may be secured at any location by any suitable means which are wholly a function of the apparatus. It is contemplated that mechanical, electromechanical, electrical or pneumatic clamping or securing means may be applied to the disclosed invention.

This method of threading wires in a wire coating apparatus may be extended to include the simultaneous threading and transport of a plurality of die bars. This requires only that at the initial threading step that the several die bars be first positioned in the desired sequence and secured to the transport cables 200. Then, the bare wires from the annealing over or supply spools are then strung sequentially through the dies and then secured above the uppermost die bar. The transport cables 200 may then be moved along the process path which acts to transport the plurality of die bars through the wire coating apparatus.

Use of the invention with a plurality of die bars is especially useful as the die bars may be rapidly deployed at desired positions along the process path of a single-pass or multi-pass wire insulating process. This process is expedited by the preferred locking means, i.e., a tapered key with a release arm which allows for die bars to be rapidly disengaged from moving transport cables, and thus eliminate the necessity of stopping the transport cables while disengaging and deploying die bars along the process path.

This method also eliminates wire normally wasted as stringing wire in a wire insulating apparatus, and reduces undesirable oxidation of wire, which results in faster process startup and elimination of wire waste. Further, the invention lends itself to automatic threading machinery wherein a die bar having incorporated locking means may be used to automatically thread a multi-pass process wherein the die bars may be automatically released and disengaged from transport cables and secured at desired positions automatically by machinery, thus reducing the necessity of a human operator in the threading process.

It is to be understood that alternative embodiments may be incorporated in the invention without detracting from the spirit and scope of the invention thereof.

I claim:

1. An improved die bar having two ends and at least one hole for a die situated therebetween;

wherein the improvement comprises:

end holes in the die bar at or near the ends thereof suitably sized for passing a transport cable therethrough, and locking means incorporated in the die bar and associated with said end holes for slidably engaging and releasing transport cables passing through the die bar end holes.

2. An improved die bar having two ends and at least one hold for a die situated therebetween;

wherein the improvement comprises:

end holes in the die bar at or near the ends thereof suitably sized for passing a transport cable therethrough, and locking means incorporated in the die bar and associated with said end holes for releasably engaging transport cables passing through the die bar end holes, wherein the locking means comprises a tapered portion in each of the holes through the die bar and a tapered key suited to be slidably engaged against the tapered portion of each of the holes and against the transport cable.

3. Apparatus as in claim 2 wherein the tapered key includes a release arm for selectively disengaging the tapered key from the tapered portion of the hole and from the transport cable.

4. A method of transporting wires along the process path of a wire coating apparatus comprising:

providing at least one die bar having two ends and at least one die situated therebetween wherein the die bar includes;

holes in the die bar at or near the ends thereof suitably sized for passing a transport cable therethrough, and releaseable locking means incorporated in the die bar for engaging transport cables passing through the holes in the die bar positioned between the parallel transport cables and having a portion of one of each parallel transport cables passing through one of the two holes in each die bar;

threading at least one wire through at least one die in the die bar;

securing the section of the wire which has passed through the die bar;

engaging the locking means so to engage the transport cables passing through the die bar;

moving the transport cable along the process path.

5. The method of claim 4 which further comprises the step;

releasing the engaged locking means so to disengage the transport cables after the die bar has reached a satisfactory position.

6. The method of claim 4 which further comprises the step;

threading the wires through dies in a plurality of additional die bars.

* * * * *

UNITED STATES PATENT AND TRADEMARK OFFICE

CERTIFICATE OF CORRECTION

PATENT NO. : 4,759,960

DATED : July 26, 1988

INVENTOR(S) : Mohammad F. Zaman

It is certified that error appears in the above-identified patent and that said Letters Patent is hereby corrected as shown below:

Col. 6, Claim 2, line 51, "hold" should be --hole--

Signed and Sealed this

Thirteenth Day of December, 1988

*Attest:*

DONALD J. QUIGG

*Attesting Officer*

*Commissioner of Patents and Trademarks*